US006540841B1

(12) United States Patent
Roy et al.

(10) Patent No.: US 6,540,841 B1
(45) Date of Patent: Apr. 1, 2003

(54) METHOD AND APPARATUS FOR REMOVING CONTAMINANTS FROM THE PERIMETER OF A SEMICONDUCTOR SUBSTRATE

(75) Inventors: Sudipto Ranendra Roy, Singapore (SG); Subhash Gupta, Singapore (SG); Simon Chooi, Singapore (SG); Xu Yi, Singapore (SG); Yakub Aliyu, Singapore (SG); Mei Sheng Zhou, Singapore (SG); John Leonard Sudijono, Singapore (SG); Paul Kwok Keung Ho, Singapore (SG)

(73) Assignee: Chartered Semiconductor Manufacturing Ltd., Singapore (SG)

( * ) Notice: Subject to any disclaimer, the term of this patent is extended or adjusted under 35 U.S.C. 154(b) by 144 days.

(21) Appl. No.: 09/607,284

(22) Filed: Jun. 30, 2000

(51) Int. Cl.[7] ..... B08B 7/00
(52) U.S. Cl. ..... 134/6; 134/7; 15/77
(58) Field of Search ..... 134/6, 7, 902; 15/77

(56) References Cited

U.S. PATENT DOCUMENTS 5,144,711 A 9/1992 Gill, Jr. ..... 15/97.1
5,806,126 A * 9/1998 de Larios et al. ..... 134/26
5,858,109 A * 1/1999 Hymes et al. ..... 134/2
5,862,560 A 1/1999 Jensen et al. ..... 15/77
5,868,863 A * 2/1999 Hymes et al. ..... 134/2
5,868,866 A * 2/1999 Maekawa et al. ..... 134/1
5,976,267 A 11/1999 Culkins et al. ..... 134/6
6,106,635 A * 8/2000 Hamada et al. ..... 134/144
6,261,378 B1 * 7/2001 Hashimoto et al. ..... 134/26

* cited by examiner

*Primary Examiner*—Randy Gulakowski
*Assistant Examiner*—Saeed Chaudhry
(74) *Attorney, Agent, or Firm*—George O. Saile; Rosemary L. S. Pike

(57) ABSTRACT

A new method and apparatus is provided that can be applied to clean outer edges of semiconductor substrates. Under the first embodiment of the invention, a brush is mounted on the surface of the substrate around the periphery of the substrate, chemicals are fed to the surface that is being cleaned by means of a hollow core on which the cleaning brush is mounted. The surface that is being cleaned rotates at a relatively high speed thereby causing the chemicals that are deposited on this surface (by the brush) to remain in the edge of the surface. Under the second embodiment of the invention, a porous roller is mounted between a chemical reservoir and the surface that is being cleaned, the surface that is being cleaned rotates at a relatively high speed. The chemicals that are deposited by the interfacing porous roller onto the surface that is being cleaned therefore remain at the edge of this surface thereby causing optimum cleaning action of the edge of the surface. After contaminants have been removed in this manner from the surface, the surface can be further cleaned by applying DI water.

12 Claims, 1 Drawing Sheet

METHOD AND APPARATUS FOR REMOVING CONTAMINANTS FROM THE PERIMETER OF A SEMICONDUCTOR SUBSTRATE

BACKGROUND OF THE INVENTION (1) Field of the Invention

The invention relates to the fabrication of integrated circuit devices, and more particularly, to methods and apparatus for removal of copper residue from the edge or periphery of wafers using a process of Chemical and Mechanical cleaning.

(2) Description of the Prior Art

The manufacturing of semiconductor devices typically includes numerous steps of forming device features and of planarizing semiconductor surfaces. The undesired fall-out of many of these steps is that materials that are used during these steps are deposited or migrate to areas from where these material must be removed by processing steps of polishing of surfaces, rinsing of surfaces and the like. All of these steps have as objective to remove contaminants from regions where these contaminants cannot be tolerated and where their presence has a serious negative yield impact.

Chemical Mechanical Polishing (CMP) is a technique that is part of the overall process of creating semiconductor devices. Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on a substrate. One typical chemical mechanical polishing process uses a large polishing pad that is located on a rotating platen against which a substrate is positioned for polishing, and a positioning member which positions and biases the substrate on the rotating polishing pad. Chemical slurry, which may include abrasive materials therein, is maintained on the polishing pad to modify the polishing characteristics of the polishing pad in order to enhance the polishing of the substrate.

The profile of the polishing pad plays an important role in determining good overall polishing results. The polishing pad can, for instance, be profiled thick at the inner diameter of the polishing pad as compared to the outer diameter of the polishing pad and visa versa. The profile of the polishing pad is typically achieved by trial and error and by adjusting the position of a diamond dresser. This method of profiling the polishing pad is destructive, time consuming and causes the loss of the polishing pad. Since this measure of the polishing pad profile can only be performed at the end of the useful life of the polishing pad, the wrong profile can only be detected after the polishing pad has served its useful life.

A polishing pad is typically fabricated from a polyurethane and/or polyester base material. Pads can for instance be specified as being made of a microporous blown polyurethane material having a planar surface and a Shore D hardness of greater than 35 (a hard pad). Other materials used for polishing pads are foam polyurethane, sueded foam polyurathene, unwoven fabric, resin-impregnated unwoven fabric. Semiconductor polishing pads are commercially available such as models IC1000 or Scuba IV of a woven polyurethane material.

In the art of fabricating semiconductors, it is important that the surface of a semiconductor wafer be planar in order to meet the requirements of optical projection lithography. The assurance of planarity is crucial to the lithography process, as consistent and uniform depth of focus of the lithography process across a surface is often inadequate for surfaces that do not have good planarity.

During the fabrication of VLSI and ULSI semiconductor wafers, it is also critically important to use wafers that are free of any surface $Cu^{+}$ or $Cu^{++}$ ions since the presence of these impurities has a direct and negative effect on device yield and throughput. It is therefore of extreme importance to use effective means for the control and removal of these impurities from the surface of the wafer since these impurities may, during further high temperature processing steps, diffuse into the wafer surface thereby substantially altering the chemical composition of the wafer. In addition, impurities can be classified as donor or acceptor dopants; these dopants will have an impact on the performance of subsequently produced semiconductor devices. Yet other impurities may cause surface dislocations or internal stacking misalignments or faults further having a negative impact on semiconductor manufacturing yield and cost. It is therefore clear that an effective method must be available to thoroughly clean the surface of the semiconductor substrate from all impurities while this process of removal may have to be repeated at various intervals during the complete processing sequence.

In the conventional approach of applying the process of CMP, the wafer is held in a circular carrier, which rotates. The polishing pad, made from a synthetic fabric, is mounted on a polishing platen, which has a flat surface and which rotates. The rotating wafer is brought into physical contact with the rotating polishing pad; this action constitutes the Chemical Mechanical Polishing process. Slurry, which typically includes pH-balanced chemicals, such as sodium hydroxide, and silicon dioxide particles, is dispensed onto the polishing pad typically using a peristaltic pump. The excess slurry typically goes to a drain, which means that the conventional CMP process has an open loop slurry flow and therefore may use and dispense an excessive amount of slurry that may add significantly to the processing cost. During this process of polishing, rate of slurry flow must also be exactly controlled.

One of the problems that is encountered during manufacturing of semiconductor devices is that the cleaning of the wafer edge has been a relatively neglected area. A conventional CMP process is such that the edge of the wafer, both front and back, are not directly exposed to the CMP process. For these reasons, the edge not only does not get cleaned but it also acts like a trap zone where contaminants easily get trapped and accumulate. It is clear from the above that contaminants that are introduced via the wafer edge can significantly impact device yield. The invention provides a apparatus and method to further clean the wafer edge and to thereby further remove contaminants, particularly copper residue, from the periphery of the semiconductor wafer.

In a typical arrangement of cleaning wafer surfaces, double sided brushes or scrubbers are provided that simultaneously affect both sides of the wafer surface that is being cleaned. The wafer is typically held on a conveyer belt and moved, by the conveyer belt, to the position between the two brushes. In order for the wafer to remain in place while the wafer is being transported and while its surface is being cleaned, an arrangement of rollers is provided that keeps the wafer in one horizontal plane while it moves into and through the cleaning brushes. An arrangement if this type has the drawback that, for the roller to keep the wafer in place in the manner indicated and without causing mechanical damage to the wafer, the force that can be exerted by the cleaning rollers on the surface of the wafer cannot be very high. This results in poor removal of the contaminants from the surface of the wafer. In addition, this configuration cannot reach the bevel area of the wafer to effectively clean this area. Finally, this configuration does not allow for selective cleaning of the wafer edge including the front, bevel and the backside of the wafer. In applying this cleaning technique, the chemical that is used during the cleaning process is exposed to both the edge of the wafer and to the other wafer surfaces. Some of the cleaning chemicals are only desired at the edge of the wafer while they are not desired to be present on the other wafer surfaces and are therefore not used when applying conventional cleaning techniques.

The present invention provides a method and apparatus for cleaning the edge of substrates, including the bevel area if such an area is present.

U.S. Pat. No. 5,976,267 (Culkins et al.) shows 2 pads, one on top and one under the wafer. This appears very close the first embodiment of the present invention. U.S. Pat. No. 5,976,267 however applies a large brush arrangement that is extended over and mounted above the surface of the wafer whereby one of the extremities of this brush has different abrasive action. This as opposed to the first embodiment of the present invention whereby the polishing brush is mounted on the edge of the wafer that is being polished. The second embodiment of the present invention uses a vertically mounted brush as opposed to a brush arrangement under U.S. Pat. No. 5,976,267 whereby the brush is mounted in parallel with the surface that is being cleaned. The vertical mount also acts as an axis arrangement such that the single brush is in contact with the front, bevel and backside of the wafer.

U.S. Pat. No. 5,862,560 (Jensen et al.) shows 2 pads, one on top and one under the wafer. This also appears very close the first embodiment of the present invention. U.S. Pat. No. 5,862,560 addresses a method for mounting and rolling a semiconductor wafer while it is being polished without providing any detail regarding the polishing of the wafer.

U.S. Pat. No. 5,144,711 (Gill, Jr.) shows a cleaning brush for a wafer. U.S. Pat. No. 5,144,711 provides a cleaning brush for cleaning semiconductor surfaces that contains two parallel surfaces whereby the wafer is clamped between these surface in an off-center manner such that at any given time only part of the wafer surface is being cleaned.

None of the methods that are referred to above shows a method that can be applied to clean all three surfaces, that is top, edge and bottom, of a wafer simultaneously. Additionally, none of these methods can apply the cleaning solution exclusively to the edge. Finally, none of the existing methods have a method of delivering chemicals that is a closed loop system, which not only measures the chemical accurately but in addition saves chemicals.

SUMMARY OF THE INVENTION

A principle objective of the invention is to provide a method and apparatus for the cleaning of the outer edge of semiconductor substrates.

In accordance with the objectives of the invention a new method and apparatus is provided that can be applied to clean the outer edges of semiconductor substrates. Under the first embodiment of the invention, a brush is mounted on the surface of the substrate around the periphery of the substrate, chemicals are fed to the surface that is being cleaned by means of a hollow core on which the cleaning brush is mounted. The surface that is being cleaned rotates at a relatively high speed thereby causing the chemicals that are deposited on this surface (by the brush) to remain in the edge of the surface. Under the second embodiment of the invention, a porous roller is mounted between a chemical reservoir and the surface that is being cleaned, the surface that is being cleaned rotates at a relatively high speed. The chemicals that are deposited by the interfacing porous roller onto the surface that is being cleaned therefore remain at the edge of this surface thereby causing optimum cleaning action of the edge of the surface. After contaminants have been removed in this manner from the surface, the surface can be further cleaned by applying DI water.

DESCRIPTION OF THE PREFERRED EMBODIMENTS

Figure 1:
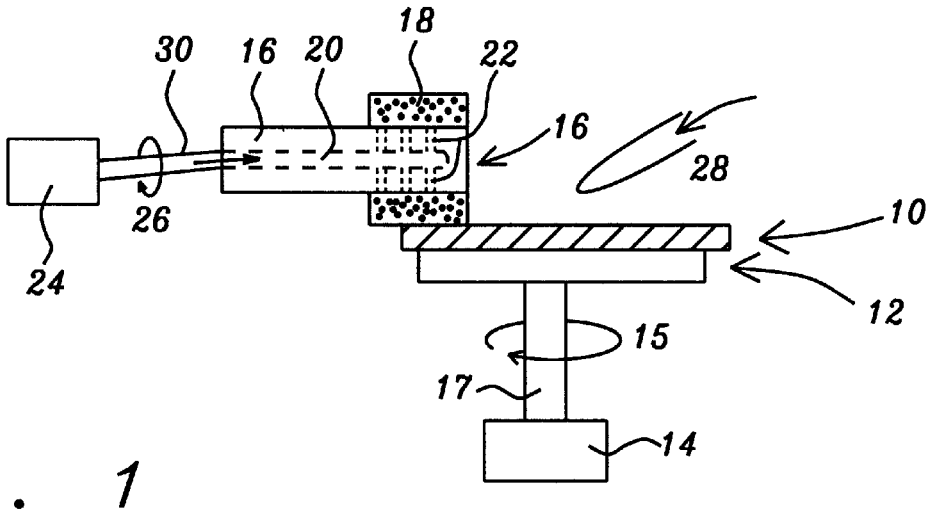
FIG. 1 shows a cross section of the cleaning apparatus of the first embodiment invention.

Referring now specifically to FIG. 1, there is shown a cross section of the apparatus of the first embodiment of the invention. The main components of the apparatus of the first embodiment of the invention are as follows:

10 is the wafer that is being cleaned

12 is the wafer carrier or holding chuck

14 is the rotary motor that rotates wafer 10 while the surface of the wafer is being cleaned

15 is the direction of the rotational motion of motor 14

16 is the (teflon) cylinder that is used for mounting the brush that cleans the surface of wafer 10

17 is the central axis that connects the motor 14 to the wafer holding chuck 12 and that thereby transfers the rotary motion of motor 14 to the wafer holding chuck 12

18 is the brush that contacts the surface of wafer 10 that is being cleaned and that therefore performs the cleaning action

20 is a hollow core that has been provided in the center of the cylinder 16, chemicals are provided through this hollow core to the cleaning brush 18

22 are channels that extend from the hollow core 20 to the inner surface of bush 18 from where the chemicals, through centrifugal forces, are propelled to the outer surface of the brush 18. The inner surface (not highlighted) of brush 18 is hereby defined as that longitudinal surface of brush 18 that is not in contact with the surface of wafer 10 that is being cleaned, the outer surface (not highlighted) of brush 18 is defined as that longitudinal surface of brush 18 that is in contact with the surface of wafer 10

24 is the rotary motor that rotates brush 18 while the surface of the wafer 10 is being cleaned

26 is the direction of the rotational motion of motor 24

28 is a DI rinse with water

30 is the central axis that connects motor 24 to cylinder 16 and that thereby transfers the rotary motion of motor 24 to cylinder 16.

The operation of the apparatus that has been shown in cross section in FIG. 1 is as follows. A wafer (10) is placed on the wafer holding chuck 12 and held in place using conventional methods (not shown in FIG. 1) of vacuum suck, the application of adhesives, and the like. The exposed surface of wafer 10, that is the surface of wafer 10 that is not in contact with the wafer holding chuck 12, is the surface that must be cleaned. Motor 14 is, after wafer 10 has been mounted on the surface of chuck 12, activated thereby providing a relatively high-speed rotary motion 15 to the wafer 10. The cylinder 16 with the thereon mounted brush 18 is brought into position such that brush 18 is in close physical contact with the exposed surface of wafer 10. This positioning of cylinder 16 and brush 18 (not shown in FIG. 1) can take place by for instance pivoting the axis 30 that drives cylinder 16 around a point that is selected on this axis 30 thereby lowering the cylinder 16 with the thereon mounted brush 18. Another method is whereby either the wafer 10/wafer holding chuck 12 and/or the cylinder 16/brush 18 are moved in a horizontal plane with respect to each other whereby a horizontal plane is a plane that is parallel to the surface of wafer 10. Key to this operation of positioning the brush 18 with respect to the exposed surface of wafer 10 is that, at the point where this positioning is considered complete, the surface of the brush 18 that is in contact with the exposed surface of wafer 10 makes uniform contact with the exposed surface of wafer 10 along the line of contact.

It is key to point out that the rotating motion 15 of wafer 10 is a high speed rotating motion. The high speed is of importance since this high speed assures that the chemicals, that are provided to the brush 18 via the path 20–22, remain in the edge portion of the exposed surface of wafer 10, forced by the centrifugal force that is exerted on the chemicals by the high rotational speed of the surface of wafer 10. Semiconductor devices, which typically reside in the center of the wafer, are therefore not affected by the chemicals while the chemicals provide the desired cleaning action on the edge of the surface of wafer 10. It is further clear that the cleaning action that is provided for the edge of wafer 10 can be controlled by applying a downward force (not shown in FIG. 1) on the cylinder/brush combination. The implementation of a rotary bearing (not shown in FIG. 1) that is clamped around the rotating cylinder 16 makes the implementation of such a downward force possible.

After the cleaning action that has been described above has been completed, the exposed surface of wafer 10 can further be cleaned by the application of a DI water rinse 28 across the exposed surface of wafer 10.

Figure 2A:
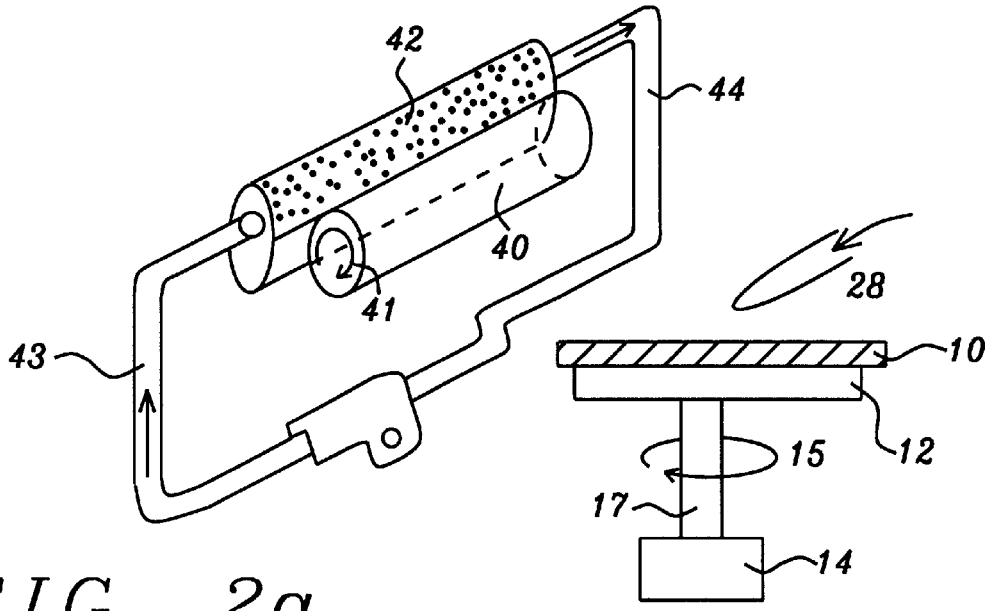
FIG. 2*a* shows a cross section of the cleaning apparatus of the second embodiment of the invention.

Referring now to FIG. 2*a*, there is shown a cross section of the apparatus of the second embodiment of the invention. Some of the components that are shown in cross section under FIG. 2*a* have previously been identified under FIG. 1 but will for convenience again be identified below. As follows:

- 10 is the wafer that is being cleaned
- 12 is the wafer carrier or holding chuck
- 14 is the rotary motor that rotates wafer 10 while the surface of the wafer is being cleaned
- 15 is the direction of the rotational motion of motor 14
- 17 is the central axis that connects the motor 14 to the wafer holding chuck 12 and that thereby transfers the rotary motion of motor 14 to the wafer holding chuck 12
- 28 is a DI rinse with water
- 40 is a porous roller that cleans the surface of wafer 10 and that additionally transfers cleaning chemicals from a chemical supply reservoir to the surface that is being cleaned,
- 41 is the rotational motion of the porous roller 40,
- 42 is a chemical supply reservoir that contains the cleaning chemicals that are used to clean the exposed surface of wafer 10,
- 43 is the feeding of the chemical cleaning supplies into the chemical reservoir 42, and.
- 44 is the removing of the chemical cleaning supplies from the chemical reservoir 42.

From the configuration that is shown in FIG. 2*a* it is clear that the chemicals that are used can be recycled resulting in potential savings of the chemicals. This closed loop chemical supply is to be opposed to the conventional methods of chemical supply, which are open loop systems that typically result in considerable loss of chemicals. The chemical supply reservoir 42 has a continuous flow, with chemicals entering (43) and exiting (44) thereby recycling the chemicals that are used for the cleaning process.

Figure 2B:
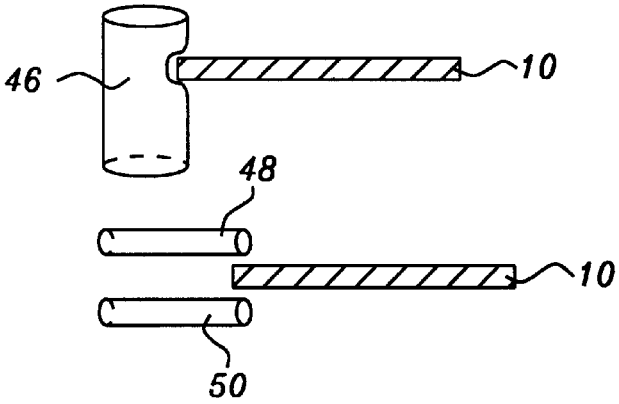
FIG. 2*b* shows a cross section two roller arrangements that can be used with the cleaning apparatus of the second embodiment of the invention.

FIG. 2*b* shows two different roller arrangements that can be used for the cleaning process of the invention, as follows:

- 46 is a roller arrangement that presses against the edge of wafer 10, and
- 48 and 50 is a combination of two rollers that keep the wafer 10 in place while the exposed surface of wafer 10 is being cleaned.

The operation of the apparatus of the second embodiment of the invention is as follows. The process of clamping the wafer 10 on the surface of the wafer holding chuck is identical to that process as described previously under FIG. 1. The second embodiment differs from the first embodiment of the invention in the manner in which the surface of the wafer 10 is being cleaned and, additionally, in the manner in which the cleaning chemicals are brought to the surface that is being cleaned. Under the first embodiment of the invention, the brush that performs the cleaning rotates around an axis that essentially passes through the geometric center of the rotating wafer 10. Under the second embodiment of the invention, the porous roller that performs the cleaning action rotates around an axis that is mounted in a direction that is essentially tangential to the circumference of the exposed surface that is being cleaned. The line of contact between the brush of the first embodiment of the invention and the surface that is being cleaned is radial to the surface of the wafer that is being cleaned, the line of contact between the porous roller of the second embodiment of the invention and the surface that is being cleaned is tangential to the radius of the surface of the wafer that is being cleaned.

Key to the second embodiment of the invention is the porous roller 40 that rotates around its central axis (not shown) in the direction 41. The porous roller 40 also forms a physical interface between the surface of wafer 10 that is being cleaned and the reservoir 42 that contains the cleaning chemicals. As such, the porous roller extracts the cleaning agents from the reservoir 42 while it passes, in a rolling motion, through the reservoir 42, absorbs these cleaning chemicals and, at a later point in its circular trajectory, deposits the cleaning chemicals onto the surface of wafer 10 that is being cleaned. The purity of the chemical agents that are used to clean the exposed surface of wafer 10 can be controlled by the replacement rate of these chemicals in reservoir 42. It must be understood that, on the return trajectory of the porous roller 40 from the surface that is being cleaned to the reservoir 42, contaminants that must be removed from the surface of wafer 10 are transported by the porous roller 40 from the exposed surface that is being cleaned to the reservoir 42 and are, at the end of this transport, deposited into reservoir 42. Faster flow 43 and/or 44 will result in more cleaning agent with the therein contained contaminants being replaced in reservoir 42, thereby removing more contaminants from the surface of wafer 10 that is being cleaned. While the porous roller 40 makes tangential contact with the surface of wafer 10, the pressure that is exerted by the porous roller 40 can further be increased by, for instance, mounting roller bearings on the axis (not shown in FIG. 2*a*) around which the porous roller rotates. By increasing this pressure, the cleaning action can be increased.

FIG. 2*b* shows two brush (46 and 48/50) configurations, in FIG. 2*b* the wafer that is being cleaned is again highlighted with 10. The combination 48/50 with the wafer 10 can further be used as only brush 48 with wafer 10 or only brush 50 with wafer 10, all of these brush configurations that are shown in FIG. 2*b* relate to the overall configuration that is shown in FIG. 2*a*.

Figure 2C:
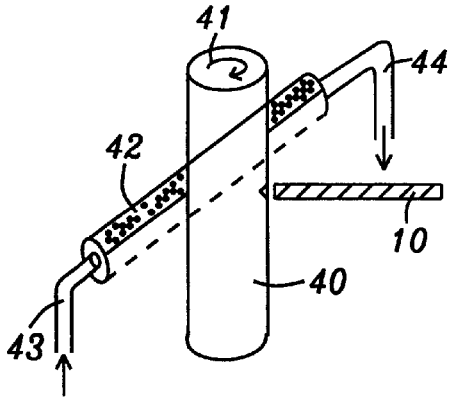
FIG. 2*c* shows an additional configuration.

FIG. 2*c* shows a different arrangement wherein the rotational direction 41 is imparted to the porous roller 40 whereby the porous roller 40 is mounted in a vertical position. Wafer 10 is pressed against the porous roller 40 thereby exposing the edge of the wafer to the process of wafer edge cleaning. Item 42 is again the chemical supply reservoir that contains the chemicals that are used to clean the edge of wafer 10, the chemicals enter (43) and exit (44) the reservoir in a closed loop system thereby enabling considerable savings in the chemicals that are used for the cleaning process. It is clear from the arrangement that is shown in FIG. 2*c* that the porous roller 40 is in a plane that is perpendicular to the plane of the wafer 10. The porous roller 42 will therefore not, as opposed to the arrangement that is shown in FIG. 2*a*, directly make contact with the cleaning supply reservoir 42 (as is the case in FIG. 2*a*). Cleaning chemicals will be supplied to the surface of wafer 10 by the method 28 of FIG. 2*a*, whereby type cleaning chemicals will be broadcast over the surface of the wafer 10.

The process of cleaning the exposed surface of wafer 10 can, after the process of the invention has been completed, be further extended by applying a DI water rinse 28, as under the first embodiment of the invention.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method for cleaning a surface of a semiconductor wafer, said wafer having a peripheral edge and a center point spaced apart from and circumscribed by said peripheral edge, said method comprising:

providing a semiconductor wafer;

providing a reservoir comprising cleaning chemicals;

mounting said semiconductor wafer onto the surface of a wafer holding chuck;

mounting a cylinder having an outside surface in such a manner that a central axis of said cylinder is parallel to a surface of said semiconductor wafer, whereby said central axis furthermore intersects with said center point of said semiconductor wafer, whereby a cylindrical brush is attached to and mounted longitudinally on said outside surface of said cylinder thereby leaving a longitudinal surface of said cylindrical brush exposed;

providing said wafer holding chuck with a rotating motion;

providing said cylinder with a rotating motion; establishing a first physical contact between said surface of said semiconductor wafer and said exposed longitudinal surface of said cylindrical brush whereby said first physical contact is uniform along the first physical contact; and providing a second contact between said reservoir comprising cleaning chemicals and said cylindrical brush.

2. The method of claim 1 wherein said cylinder has a longitudinal dimension of height in addition to a cross section taken in a plane that is perpendicular to its central axis that has an outside diameter of measurable value, and that further comprises:

a means for transporting cleaning chemicals from a chemical reservoir that contains cleaning chemicals to the surface of said semiconductor wafer; and a means for rotating said cylinder.

3. The method of claim 2 wherein said rotating said cylinder is imparted to said cylinder by means of a central axis that extends in a direction that coincides with a direction of its central axis between said cylinder and a rotating motor thereby providing a rotating motion to said cylinder.

4. The method of claim 2 wherein said means for, transporting cleaning chemicals comprises:

a means for supplying cleaning chemicals to a cylindrical hollow core that has been provided for this purpose in a center of said cylinder; and a means for flowing said cleaning chemicals from said hollow core to the surface of said semiconductor wafer.

5. The method of claim 4 whereby said hollow core extends longitudinally around a central axis of said cylinder in a direction of said longitudinal height of said cylinder whereby furthermore said hollow core has a cross section taken in a plane that is perpendicular to its central axis with an outside diameter that is smaller than said outside diameter of said cylinder by an amount.

6. The method of claim 4 whereby said means for flowing said cleaning chemicals from said hollow core to a surface of said semiconductor wafer comprises a multiplicity of channels in said cylinder extending in a radial manner from said hollow core of said cylinder to an outside surface of said cylinder.

7. The method of claim 4 with the addition of supplying cleaning chemicals to said hollow core of said cylinder.

8. The method of claim 1 wherein said cylindrical brush that is attached to and mounted on an outside of said cylinder has a cross section taken in a plane that is perpendicular to a central axis of said cylindrical brush that comprises an inner circle and a therewith concentric outer circle, whereby the diameter of said inner circle essentially equals an outer diameter of said cylinder, whereby furthermore said outer circle of said cylindrical brush has a diameter that exceeds a diameter of said inner circle of said cylindrical brush by an amount, whereby a substantive material that constitutes said brush is concentrated between said inner circle and said outer circle of said cylindrical brush in a direction of said central axis of said cylinder over a distance that is shorter than said longitudinal dimension of height of said cylinder by an amount.

9. A method for cleaning the surface of a circular semiconductor wafer, said wafer having a peripheral edge and a center point spaced apart from and circumscribed by said peripheral edge, said method including:

providing a semiconductor wafer;

mounting said semiconductor wafer onto the surface of a wafer holding chuck;

providing a porous roller of cylindrical form that is activated with a rolling motion around its central axis whereby said porous roller contains an exposed longitudinal surface;

providing said wafer holding chuck with a rotating motion of relatively high speed;

providing a chemical reservoir containing cleaning chemicals;

providing said porous roller with a rotating motion; and establishing a first contact between said exposed longitudinal surface of said porous roller and said surface of said circular semiconductor wafer whereby said first contact is uniform along said first contact thereby furthermore establishing a second contact between said exposed longitudinal surface of said porous roller and said chemical reservoir containing cleaning chemicals.

10. The method of claim 9 whereby said chemical reservoir containing cleaning chemicals is mounted in a position that is parallel with said central axis of said cylindrical porous roller.

11. The method of claim 10 with the additional of entering into and removing from said chemical reservoir said cleaning chemicals thereby replacing said cleaning chemicals that are contained within said chemical reservoir said replacement being affected at either a constant or a varying rate of replacement.

12. The method of claim 9 whereby said porous roller is mounted in a manner such that the central axis of said porous roller is essentially tangential with the circumference of said circular semiconductor wafer and whereby furthermore the central axis of said porous roller is essentially parallel to a surface of said circular semiconductor wafer whereby said central axis of said porous roller is located above said peripheral edge of said circular semiconductor wafer whereby furthermore said porous roller is in contact with said surface of said circular semiconductor wafer in addition to being in contact with said cleaning chemicals that are contained in said chemical reservoir thereby siphoning said cleaning chemicals from said chemical reservoir thereby furthermore transporting said cleaning chemicals from said chemical reservoir to the surface of said circular semiconductor wafer thereby furthermore removing particles from said circular semiconductor wafer whereby said particles are deposited into said chemical reservoir containing cleaning chemicals.

* * * * *